US012612857B2

(12) United States Patent
Yang

(10) Patent No.: US 12,612,857 B2
(45) Date of Patent: Apr. 28, 2026

(54) GAS BREAKTHROUGH ANALYSIS

(71) Applicant: Equinor Energy AS, Stavanger (NO)

(72) Inventor: Tao Yang, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 12 days.

(21) Appl. No.: 18/722,732

(22) PCT Filed: Dec. 19, 2022

(86) PCT No.: PCT/NO2022/050317
§ 371 (c)(1),
(2) Date: Jun. 21, 2024

(87) PCT Pub. No.: WO2023/121472
PCT Pub. Date: Jun. 29, 2023

(65) Prior Publication Data

US 2025/0067170 A1 Feb. 27, 2025

(30) Foreign Application Priority Data

Dec. 22, 2021 (GB) ..... 2118823

(51) Int. Cl.
*E21B 47/10* (2012.01)
*E21B 43/16* (2006.01)
*E21B 47/11* (2012.01)

(52) U.S. Cl.
CPC ..... *E21B 47/10* (2013.01); *E21B 43/16* (2013.01); *E21B 47/11* (2020.05)

(58) Field of Classification Search
CPC ..... E21B 47/10; E21B 47/11; E21B 43/16
See application file for complete search history.

(56) References Cited

U.S. PATENT DOCUMENTS

2005/0016730 A1* 1/2005 McMechan ..... E21B 47/12 166/305.1
2009/0294128 A1* 12/2009 Dale ..... E21B 33/127 166/306

(Continued)

FOREIGN PATENT DOCUMENTS

GB 2682294 A 9/2020
GB 2597649 A 2/2022

(Continued)

OTHER PUBLICATIONS

International Search Report, issued in PCT/NO2022/050317, dated Feb. 15, 2023.

(Continued)

*Primary Examiner* — D. Andrews
(74) *Attorney, Agent, or Firm* — Birch, Stewart, Kolasch & Birch, LLP

(57) ABSTRACT

A method of identifying a location of gas breakthrough within a completed production well includes: obtaining production composition data and/or tracer data from the production well; analysing the production composition data and/or tracer data to determine whether gas breakthrough has occurred within the production well; and in response to determining that gas breakthrough has occurred within the production well, examining mud-gas data collected during drilling of the production well to identify a gas breakthrough location within the well where the gas breakthrough has occurred.

10 Claims, 4 Drawing Sheets

(56) References Cited

U.S. PATENT DOCUMENTS

Figure 1A:
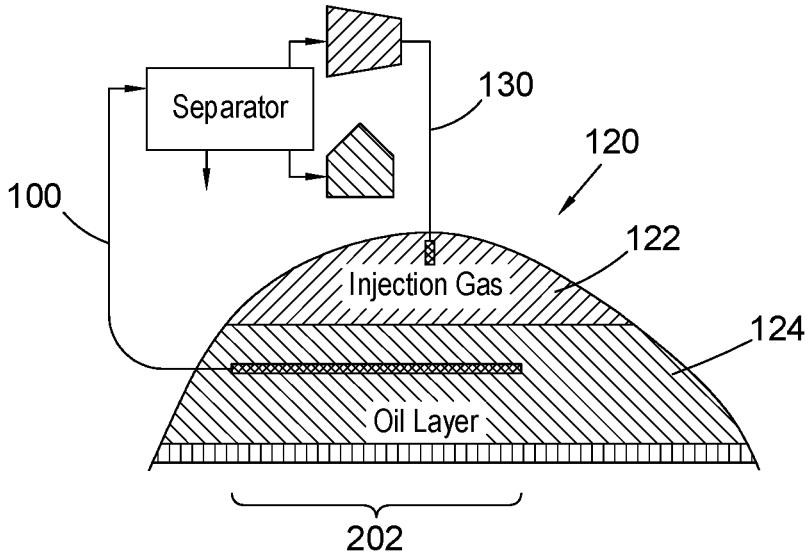

| | | | | |
|---|---|---|---|---|
| 2011/0088895 | A1* | 4/2011 | Pop | E21B 44/00 166/254.2 |
| 2019/0010792 | A1 | 1/2019 | Arthur et al. | |
| 2019/0257195 | A1 | 8/2019 | Altaheini | |
| 2024/0384632 | A1* | 11/2024 | Al-Anazi | E21B 49/0875 |

FOREIGN PATENT DOCUMENTS

| | | | |
|---|---|---|---|
| WO | WO 2019/083913 | A1 | 5/2019 |
| WO | WO 2020/194031 | A1 | 10/2020 |
| WO | WO 2022/025940 | A1 | 2/2022 |

OTHER PUBLICATIONS

United Kingdom Search Report, issued in Priority Application No. 2118823.0, dated Jun. 9, 2022.
Written Opinion of the International Searching Authority, issued in PCT/NO2022/050317, dated Feb. 15, 2023.

* cited by examiner

GAS BREAKTHROUGH ANALYSIS

The present disclosure relates to gas breakthrough analysis and particularly a method of identifying a location of a gas breakthrough within a recently completed production well.

Gas injection is a widely used technique when producing oil from oil fields in order to enhance oil recovery. As oil is produced from a reservoir the pressure within the reservoir reduces meaning that further production of oil becomes more difficult and the rate of oil production declines. Gas injection involves introducing an injection gas, such as nitrogen, carbon dioxide or hydrocarbon gas, into a reservoir via an injection well spaced some distance away from a production well. This causes the pressure in the reservoir, and thus the oil production rate, to increase.

Gas breakthrough is an issue that can occur when employing gas injection within an oil reservoir. Gas breakthrough occurs when a path is formed that allows injection gas to flow directly from an injection well to a producing well. When gas breakthrough occurs, the quantity of oil produced by the well will be reduced significantly, as the injection gas simply circulates from injection well to production well without pressurising the oil. In addition, a costly and energy intensive recycling and re-injection process is required whereby the produced injection gas is recycled and re-injected back into the reservoir. Both of these factors are detrimental to the rate and value of oil production, as well as the energy consumption and carbon emissions associated with the oil production.

Presently, common technologies to identify the occurrence of gas breakthrough are tracer analysis and well production gas oil ratio (GOR) analysis.

In tracer analysis a tracer fluid, having an identifiable or traceable chemical composition or radioactive signal, is included within the injection fluid that is injected into an oil reservoir during injection assisted production. The fluid produced by production wells within the reservoir is monitored for the presence of the tracer fluid. Properties such as the concentration and time interval between injection and production are measured allowing for inferences of the properties of the reservoir to be made.

Thus, tracer analysis can identify that gas breakthrough has occurred, and which injection well is the source of the injection gas, but not where along a particular production well the gas breakthrough has occurred.

Production GOR analysis can also be used to identify gas breakthrough within a production well. The GOR is the volume ratio of produced gas to produced oil. The volume of gas being that which comes out of solution with the oil at standard pressure and temperature. A high GOR therefore corresponds to a high production rate of gas and can be indicative of gas breakthrough occurring.

The present disclosure is particularly concerned with gas breakthrough caused by the completion of a new production well in a mature oil field. Gas breakthrough may occur in newly completed wells if the new production well is perforated in a region containing free injection gas. Commonly, 4D seismic analysis is examined when completing the well in an attempt to avoid this.

4D seismic analysis is used widely in mature fields. This is a form of time-lapse seismic analysis that comprises capturing 3D seismic survey data from a field at time-spaced intervals, often 6-month intervals, and examining changes in the data with time. The use of multiple, time-spaced data sets also allows for a 3D model of the fluid distribution within the reservoir to be produced by updating the initial reservoir fluid distribution model to account for changes over time.

However, 4D seismic interpretation does not provide quantitative reservoir fluid properties data, but rather a qualitative indication of fluid changes, caused by any one or more of pressure changes, density changes and saturation changes. Many assumptions must be made to interpret what these changes mean (e.g. gas displacing oil, or water displacing oil) which can lead to inaccuracies in the analysis. Furthermore, the practical vertical resolution of 4D seismic data is about 20-30 meters. Where oil reserves are highly segmented, this resolution can bring high uncertainties, especially for vertically thin layers.

Consequently, gas breakthrough does still occur when drilling new wells, despite this analysis being carried out. Well intervention techniques exist that allow parts of a completed production well to be closed off. However, these are expensive, and so are rarely used in the case of gas breakthrough because the location of the gas breakthrough cannot be precisely identified—if the location was known before completion, then the production well would not have been perforated at that location.

A need therefore exists for a method of identifying a location of a gas breakthrough within a completed production well.

The present invention provides a method of identifying a location of gas breakthrough within a completed production well, the method comprising: determining whether gas breakthrough has occurred within the production well; and in response to determining that gas breakthrough has occurred within the production well, examining mud-gas data collected during drilling of the production well to identify a gas breakthrough location within the well where the gas breakthrough has occurred.

Determining whether gas breakthrough has occurred within the production well may comprise: analysing production composition data and/or tracer data from the production well to determine whether gas breakthrough has occurred within the production well. Thus, the method may comprise obtaining production composition data and/or tracer data from the production well.

Production composition data is data concerning the composition of the fluid produced by the production well. The production composition data may comprise data relating to the concentration of chemical components within the fluid produced by the production well. The production composition data may comprise data relating to the gas/oil ratio (GOR) of the fluid produced by the production well. The production composition data may comprise data relating to the density of the fluid produced by the production well. The production composition data may comprise data relating to the quantities of individual chemical components or groups of chemical components within the fluid produced by the production well.

Tracer data from the production well is data collected from the fluid produced by the production well during tracer analysis of an oil field. The tracer data may comprise data relating to the concentration of tracer chemicals within the production fluid, and/or data relating to the radiation properties of the production fluid, and/or data relating to the time interval between injection and production of a traceable chemical composition or a radioactive signal.

Mud-gas data is data produced by mud-gas logging carried out during drilling of production well. Mud-gas logging comprises analysis of the gases released from drilling mud used when drilling the well. The mud-gas data may comprise data relating to concentration of $C_1$ to $C_5$ hydrocarbons released from the drilling mud corresponding to each depth within the well.

Mud-gas data is part of mud logging service for all wells, for both exploration wells and production wells. Mud-gas analysis is most commonly used as post well data to study petroleum systems during the exploration phase of a new reservoir. It is not commonly used as real-time data when drilling production wells in mature fields. However, the inventors have identified that mud gas can provide a reliable prediction of where along the well is most likely to be the source of a gas breakthrough.

The method may further comprise performing a well intervention operation within the production well at the gas breakthrough location in order to reduce production of fluid from adjacent the gas breakthrough location.

Performing a well intervention operation within the production well at the gas breakthrough location may significantly reduce production of fluid from adjacent the gas breakthrough location, for example by at least 50% or by at least 75% or by a least 90%, or may prevent production of fluid from adjacent the gas breakthrough location.

When a gas breakthrough location is identified, proactive actions to stop or reduce gas breakthrough can be taken, for example customized well intervention operations can be performed to stop gas breakthrough.

Once an intervention operation has been performed the volume of gas produced by the well is reduced meaning that rate and value of oil production is increased, and the energy consumption and carbon emissions associated with the oil production reduced.

The well intervention operation may comprise sealing or bypassing one or more perforation in a casing of the production well. Thus, fluid cannot be produced via the sealed or bypassed one or more perforation.

The method may comprise determining the one or more perforation locations within a production well to be sealed or bypassed (i.e. locations where a casing of the production well is perforated to permit inflow of reservoir fluid, corresponding to the gas break through and sealing those perforation locations).

The well intervention operation may be applied over a region spanning at least 10 meters, optionally at least 15 meters, and further optionally at least 20 meters, above and/or below the gas breakthrough location.

By sealing the well over a region spanning at least 10 meters above and/or below the gas breakthrough location protection from further gas breakthroughs caused by migration of the gas layer is also provided. This is important because well interventions are an expensive process and it is undesirable to perform repeated interventions on the same well.

The well intervention operation may seal the well bore from inflow of reservoir fluid only within the region of the gas breakthrough location, such that reservoir fluid may enter the well bore above and/or below the portion of the well bore sealed by the intervention operation, and may be subsequently produced at the surface.

The gas breakthrough location may be identified accurate to at least 10 meters, optionally to at least 5 meters, and further optionally to at least 2 meters.

Mud-gas data has much higher granularity than other data, such as 4D seismic data, often providing accuracies of around 1 m.

The method may further comprise examining at least one of 4D seismic data, cuttings data and petrophysical data associated with the production well to verify the gas breakthrough location determined using the mud-gas data.

4D seismic data, cuttings data and petrophysical data from the time of drilling the well can also provide indications of the reservoir fluid composition along the well. Therefore, these can be used in conjunction with the mud-gas data to verify the gas breakthrough location determined using the mud-gas data, or to select from amongst several locations identified using the mud-gas data. For example, 4D seismic data provide only relative information about the change in density of layers within the reservoir, mud-gas data provides a ground truth value which can augment the understanding/interpretation of such relative data.

The reliability in the identification of gas breakthrough location can be increased by examining further data.

Analysing the production composition data to determine whether gas breakthrough has occurred within the production well may comprise determining that gas breakthrough has occurred when a production GOR exceeds a predetermined threshold GOR value.

The threshold GOR value may be tailored for each reservoir, well or scenario depending on the circumstances of the investigation.

The higher the GOR value, the higher the volume percent of gas within the reservoir fluid. Above a threshold GOR level the reservoir fluid becomes undesirable to produce due to the high level of gas it comprises.

Analysing the production composition data to determine whether gas breakthrough has occurred within the production well may comprise determining that gas breakthrough has occurred when a fluid density of the production fluid is less than a predetermined threshold fluid density value.

The threshold fluid density value may be tailored for each reservoir, well or scenario depending on the circumstances of the investigation.

Reservoir fluid having a low density is indicative of fluid with a high gas concentration. Hence the production fluid having a density lower than a threshold value is indicative of gas breakthrough within the production well. Below a threshold density level the reservoir fluid becomes undesirable to produce due to the high level of gas it comprises.

Analysing the tracer data to determine whether gas breakthrough has occurred within the production well may comprise determining that gas breakthrough has occurred when the concentration of a tracer fluid within the production fluid exceeds a predetermined threshold tracer concentration value.

The threshold tracer concentration value may be tailored for each reservoir, well or scenario depending on the circumstances of the investigation.

Production fluid having a high concentration of tracer fluid is indicative of injection fluid being produced.

Examining the mud-gas data to identify the gas breakthrough location may comprise identifying a location where a methane component in the mud-gas exceeds a predetermined threshold methane concentration value.

The threshold methane concentration value may be tailored for each reservoir, well or scenario depending on the circumstances of the investigation.

The injection gas which is used during injection assisted production typically comprises high content of methane, particularly in offshore locations where hydrocarbon gases are not commercially viable to refine and sell, and can no longer be flared. Therefore identification of methane within the mud-gas data above a threshold level is indicative of the production well extending within a gas cap formed by injection gas at the corresponding location. The gas breakthrough event identified through production composition data and/or tracer data can be attributed to the location of the production well which resides within the gas cap as determined by the methane in the mud-gas data.

The mud-gas data may comprise standard mud-gas data. That is to say, the mud-gas data may not have had a recycling correction applied and/or may not have had an extraction efficiency correction applied.

Standard mud-gas data is relatively cheap to collect and typically readily available for most recently produced wells. Whilst the technique is applicable also using advanced mud-gas data, which usually has had a recycling correction and an extraction efficiency correction applied, this data is not commonly collected when drilling production wells in mature fields.

The methods in accordance with the present invention may be implemented at least partially using software, e.g. computer programs. It will thus be seen that when viewed from further aspects the present invention provides computer software specifically adapted to carry out the methods described herein when installed on a data processor, a computer program element comprising computer software code portions for performing the methods described herein when the program element is run on a data processor, and a computer program comprising code adapted to perform all the steps of a method or of the methods described herein when the program is run on a data processing system.

The present invention also extends to a computer software carrier comprising such software arranged to carry out the steps of the methods of the present invention. Such a computer software carrier could be a physical storage medium such as a ROM chip, CD ROM, DVD, RAM, flash memory or disk, or could be a signal such as an electronic signal over wires, an optical signal or a radio signal such as to a satellite or the like.

It will further be appreciated that not all steps of the methods of the present invention need be carried out by computer software and thus from a further broad embodiment the present invention provides computer software and such software installed on a computer software carrier for carrying out at least one of the steps of the methods set out herein.

The present invention may accordingly suitably be embodied as a computer program product for use with a computer system. Such an implementation may comprise a series of computer readable instructions, which may be fixed on a tangible, non-transitory medium, such as a computer readable medium, for example, diskette, CD ROM, DVD, ROM, RAM, flash memory or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic or optical, or transmitted using any communications technology, present or future, including but not limited to optical, infrared or microwave. It is contemplated that such a computer program product may be distributed as a removable medium with accompanying printed or electronic documentation, for example, shrink wrapped software, pre-loaded with a computer system, for example, on a system ROM or fixed disk, or distributed from a server or electronic bulletin board over a network, for example, the Internet or World Wide Web.

Thus, viewed from a second aspect, the present invention provides a computer program product or a tangible computer-readable medium storing a computer program product, the computer program product comprising computer readable instructions that, when executed by a computer, will cause the computer to perform a method comprising: determining whether gas breakthrough has occurred within the production well; and in response to determining that gas breakthrough has occurred within the production well, examining mud-gas data collected during drilling of the production well to identify a gas breakthrough location within the well where the gas breakthrough has occurred.

Viewed from a third aspect, the present invention provides a computer comprising: a memory, and a processor, the memory storing computer readable instructions that, when executed by the processor will perform a method comprising: determining whether gas breakthrough has occurred within the production well; and in response to determining that gas breakthrough has occurred within the production well, examining mud-gas data collected during drilling of the production well to identify a gas breakthrough location within the well where the gas breakthrough has occurred.

The computer program product or the computer may be configured to perform any of the methods described above including any one of more of the optional steps described.

Figure 1B:
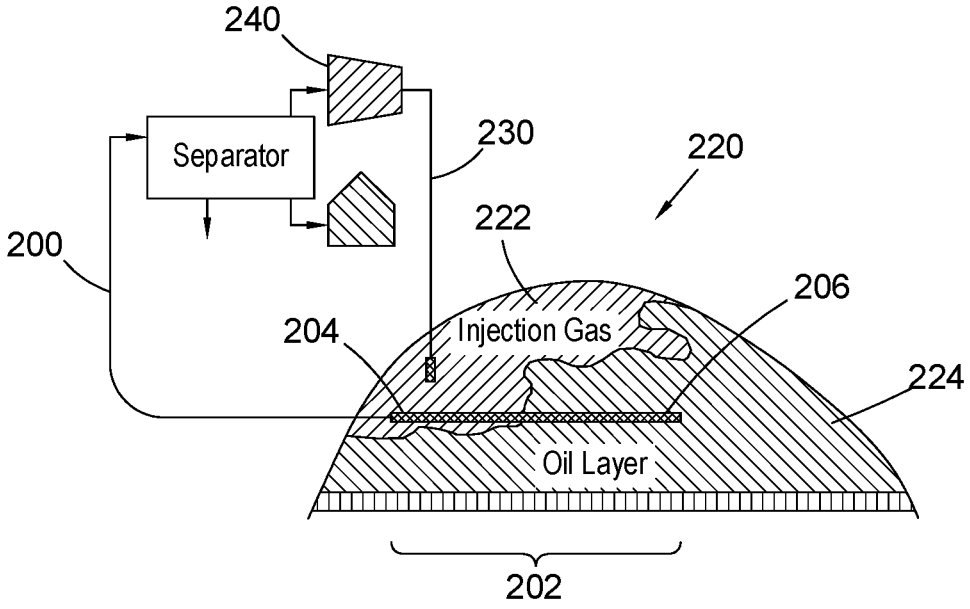
Figure 2:
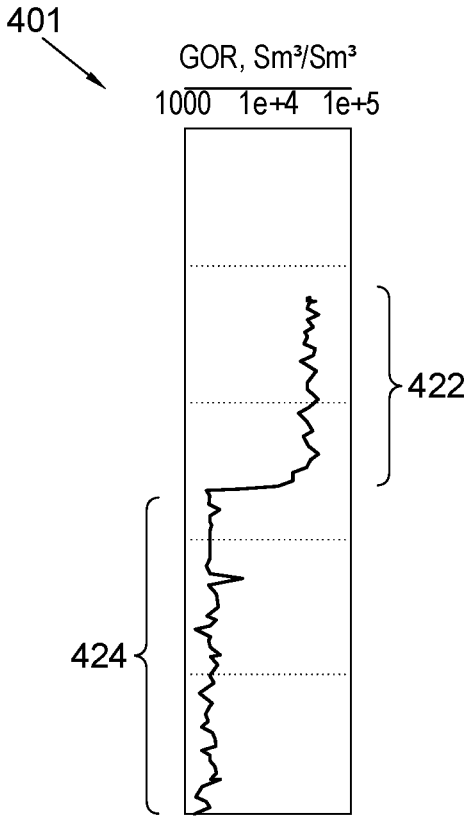
Figure 3A:
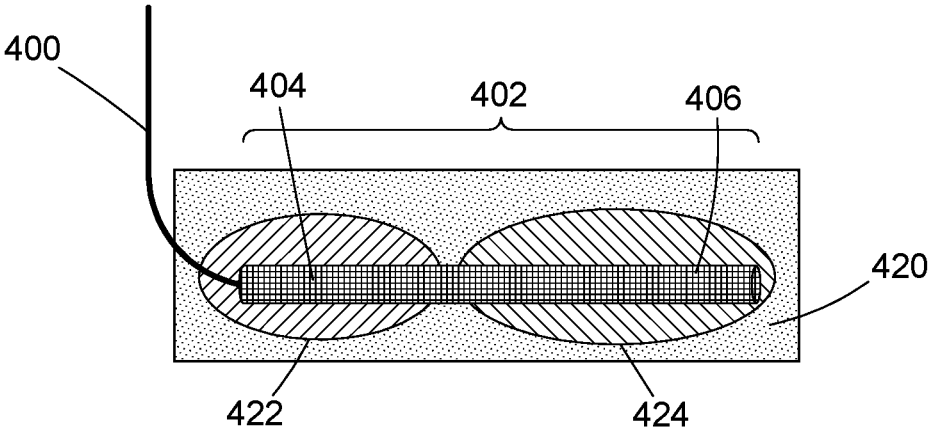
Figure 3B:
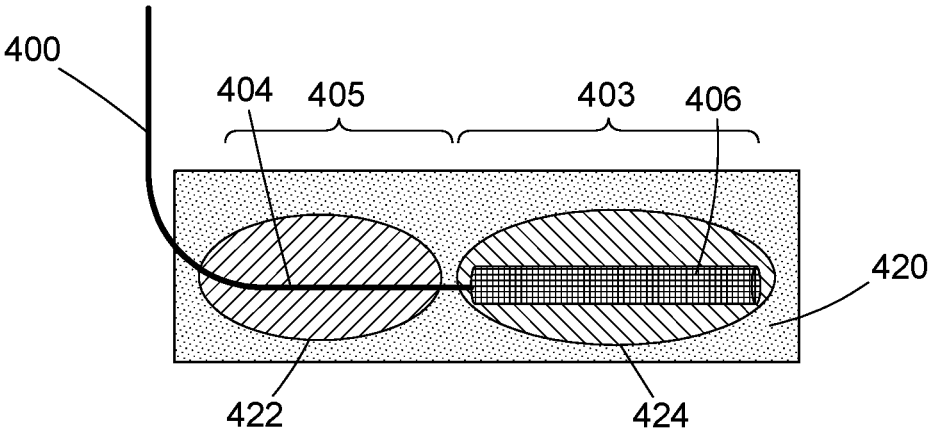
Figure 4:
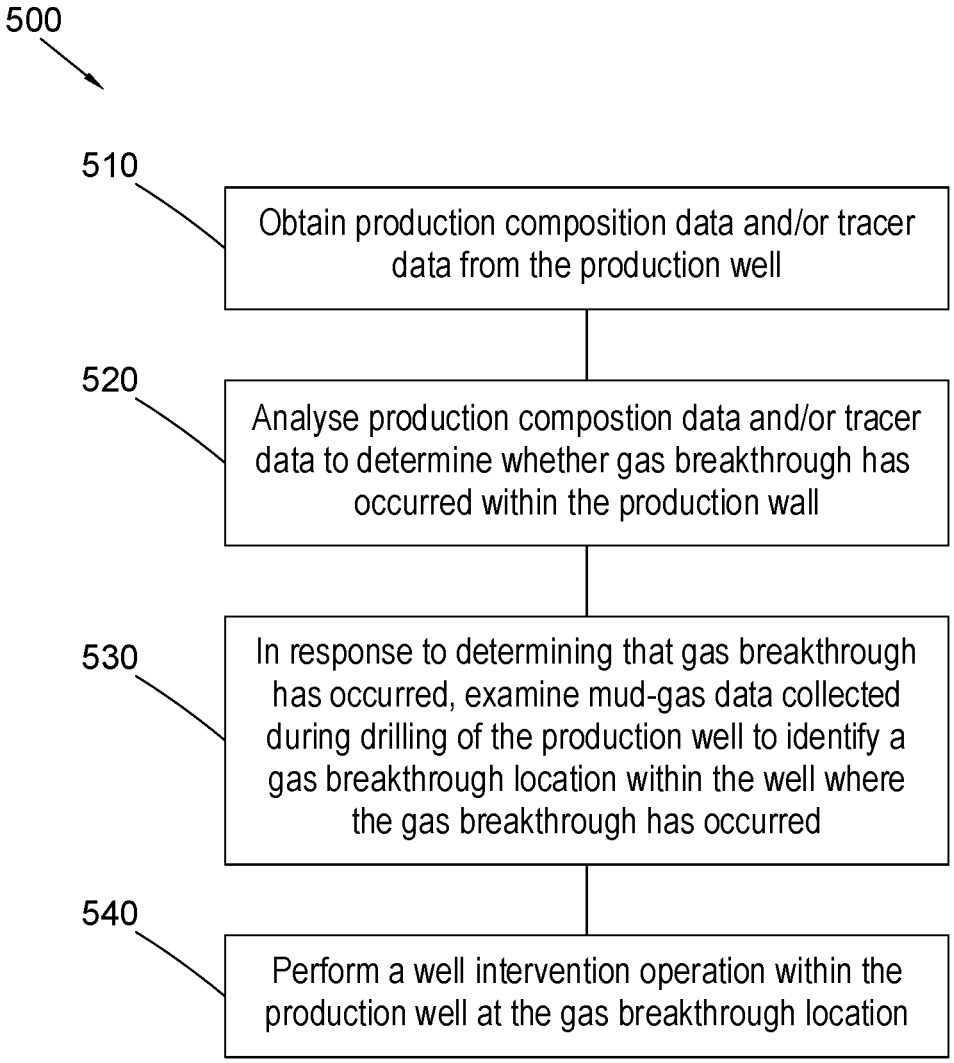

Certain preferred embodiments of the present disclosure will now be described in greater detail, by way of example only and with reference to the accompanying drawings, in which:

FIGS. 1*a* and 1*b* are schematic illustrations of gas-flooded oil reservoirs, each including a production well;

FIG. 2 is a schematic of a mud-gas log showing the GOR vs well length for a production well;

FIG. 3*a* is a schematic illustration of a production well in which gas breakthrough has occurred;

FIG. 3*b* is a schematic illustration of a production well in which an intervention operation has been carried out following gas breakthrough; and FIG. 4 is a flowchart of a method of identifying a location of gas breakthrough within a completed production well.

Exemplary oil reservoirs 120, 220 undergoing an injection assisted production process are shown schematically in FIGS. 1*a* and 1*b*.

In the injection assisted production process gas is injected in to the reservoir 120, 220 via an injection well 130, 230 whilst oil is produced from a production well 100, 200. The injection gas forms an injection gas cap 122, 222 towards the upper region of the reservoir 120, 220. The exemplary reservoirs 120, 220 include an oil layer 124, 224 beneath the injection gas cap 122, 222, 322.

The oil layer 124, 224 can have varying composition, including gas condensate, reservoir oil, or combined gas condensate and reservoir oil. However, the GOR of the injection gas cap 122, 222 will be significantly higher than the GOR of any part of reservoir fluids in the oil layer 124, 224.

The purpose of the gas injection is to displace reservoir oil towards producers and maintain sufficient pressure within the reservoir 120, 220 such that a high rate of oil production can be maintained even as the reservoir 120, 220 becomes depleted in oil. As explained below with reference to FIG. 1*b*, when gas breakthrough occurs in a production well 200, the injection gas can travel along a direct path from the injection well 230 to the production well 200. The injection gas is hence produced without sweeping the oil with the reservoir 220.

A perforated portion 102, 202 of each of the production wells 100, 200 is shown with crosshatching.

In FIG. 1*a* the entirety of the perforated region 102 of the production well 100 is within an oil layer 126 of the reservoir 120. There is therefore no gas breakthrough experienced by this production well 100 and this scenario is ideal to maximise the value of the production well 100.

Ideally, the production well 100 would pass as low as possible through the oil layer 124 to allow production of the heavier liquid hydrocarbons at the bottom of the oil layer 124. However, in practice, this is not always possible as it is difficult to predict the exact topography of the reservoir 120.

In FIG. 1*b*, the injection well 230 was not positioned optimally, as is commonly the case in practice, and the boundary between the injection gas cap 222 and the oil layer 224 is complex.

As can be seen, a lower end portion 206 of the perforated region 202 of the production well 200 is within the oil layer 224, and an upper end portion 204 of the perforated region 202 of the production well 200 is within the injection gas cap 222. Gas breakthrough is therefore experienced by the upper end portion 204 of the perforated region 202 of the production well 200 in FIG. 1*b*.

The terms "upper" and "lower" used herein refer to distance along the well, rather than vertical height. For example, in the case of a horizontal well, the upper end portion 204 and lower end portion 206 may be at substantially the same vertical depth below the surface.

In this scenario injection gas can travel along a direct path from the injection well 230 to the production well 200. Once the production fluid reaches the surface it is sent to a separator 240 where the injection gas (and often any lighter hydrocarbons released from the reservoir oil) is separated from the reservoir oil. The injection gas is then compressed in a compressor 230 and re-injected in to the reservoir 220 through the injection well 230. This recycling of the injection gas is an energy intensive process, which is both costly and energy intensive.

A technique will now be described for identifying when gas breakthrough has occurred, and for taking corrective action to remedy the gas breakthrough.

The composition of the fluid produced by a production well 100, 200 is analysed in order to monitor the type of fluid being produced, for example whether injection gas, gas condensate or reservoir oil is being produced. If the composition of the produced fluid indicates the presence of injection gas, then gas breakthrough is deemed to have occurred.

A determination that gas breakthrough has occurred can be made when a production GOR exceeds a predetermined threshold GOR value, or when a fluid density of the production fluid is less than a predetermined threshold fluid density value.

A determination that gas breakthrough has occurred can also be made using tracer analysis. During tracer analysis a tracer fluid is injected into the reservoir via an injection well 130, 230 and the fluid produced by the production wells 100, 200 is monitored for the presence of the tracer fluid. Properties such as the concentration and time interval between injection and production are measured allowing for inferences of the properties of the reservoir to be made, these results can lead to an inference that gas breakthrough has occurred.

Once it has been determined that gas breakthrough has occurred in a production well, analysis of the data produced by mud-gas logging, i.e. mud-gas data, is used to identify a location along the production well at which the gas breakthrough has occurred. Analysis of the mud-gas data can provide a location of gas breakthrough accurate to meter level.

Mud-gas logging entails gathering data from hydrocarbon gas detectors that record the levels of gases brought up to the surface in the drilling mud during a bore drilling operation. Mud-gas data is therefore specific to the wellbore.

Conventionally, mud-gas logging is used to identify the location of oil and gas zones as they are penetrated, which can be identified by the presence of hydrocarbon gas in the mud system. This may be used to provide a general indication of the type of reservoir, as well as to determine where to take downhole fluid samples for more detailed analysis of the fluid composition. The presence of hydrocarbon gas in the mud-gas may be detected, for example, with a total gas detector. Once the presence of hydrocarbon gas is detected, its composition may also be examined for example with a gas chromatograph.

Mud-gas data may be collected in different ways. The simplest form of mud-gas logging product data that is known as "standard" mud-gas data, and this is collected for most wells as they are drilled. This data corresponds simply to a measurement of the composition of the hydrocarbon gases, usually $C_1$ to $C_5$ released from the drilling mud at atmospheric pressure and temperature. More complex (and costly) data collection techniques may be used to gather "advanced" mud-gas data, and therefore this type of mud-gas data is less commonly collected.

Advanced mud-gas data refers to mud-gas data collected and processed in a specific manner. Typically, advanced mud-gas data is collected by using special analysers that heat the drilling mud to release greater quantities of gas, particularly the heavier gases, such as $C_4$ and $C_5$. Furthermore, a recycling correction and an extraction efficiency correction are applied to the data.

The recycling correction accounts for gases present within the drilling mud before injection into the well, such as from previous circulations of the drilling mud. This is usually measured by a second apparatus which examines the drilling mud before injection into the well.

The extraction efficiency correction accounts for the different solubility of each of the gases within the particular drilling mud used, such that the compositions of the advanced mud-gas data correspond closely to the corresponding compositions of the reservoir fluid.

The following technique can utilise either standard mud-gas data or advanced mud-gas data, and advanced mud-gas data will provide a more accurate determination of the location of a gas-breakthrough. However, the technique is only applied after completion of the well, when gas-breakthrough has been identified. Therefore, the technique can only employ the mud-gas data that was collected at the time of drilling, and so is primarily envisaged using standard mud-gas data.

An exemplary technique by which a log of GOR against depth can be achieved using advanced mud-gas data is described in the paper Tao Yang et. al. (2019), "A Machine Learning Approach to Predict Gas Oil Ratio Based on Advanced Mud Gas Data". Society of Petroleum Engineers. doi: 10.2118/195459-MS.

FIG. 2 shows a schematic of a GOR log 401 produced using mud-gas logging for a production well in which gas breakthrough has occurred. The lower end of the log 424 corresponds to a lower end portion of a perforated region of a production well suffering from gas breakthrough (similar to the production well 200 shown in FIG. 1*b*). The fluid adjacent this lower end portion 424 within the reservoir has a relatively low GOR indicative of fluid comprising a high proportion of reservoir fluid. The upper end of the log 422 corresponds to an upper end portion of the production well. The fluid adjacent the upper end portion has a high GOR indicative of the fluid comprising lighter hydrocarbon gases, commonly found in injection gas. The GOR log 400 can hence be used to infer that the position along the well at which gas breakthrough has occurred corresponds to the upper end portion 422 of the production well in this example.

In the case of standard mud-gas data, predictions of the reservoir fluid GOR are significantly less accurate. However, standard mud-gas data can still provide a reasonably accurate estimation of the $C_1$, $C_2$ and $C_3$ compositions of the reservoir fluid. Therefore, when using standard mud-gas data, a normalised $C_1$ log (e.g. a $C_1/C_2$ log, a $C_1/C_3$ log, or a $C_1/(C_2+C_3)$ log) may be examined to infer the position along the well at which gas breakthrough has occurred. For example, a location having a high normalised $C_1$ composition can be assumed to correspond to the position along the well at which gas breakthrough has occurred.

4D seismic data, cuttings data and petrophysical data can also be used to supplement mud-gas data and to verify the gas breakthrough location. 4D seismic data, cuttings data and petrophysical data provide indications of the reservoir fluid composition along the well. The correspondence between the indications of a gas breakthrough location from these analysis techniques and the mud-gas data can increase the confidence in the gas breakthrough location determined using the mud-gas data, or can assist in selecting a location from amongst several locations for gas breakthrough identified using the mud-gas data.

In FIG. 3*a* a production well 400 has a perforated region 402 within reservoir 420. The lower end portion 406 of the perforated region 402 in within an oil layer 424, whereas the upper end portion 404 of the perforated region 402 is within an injection gas cap 422. This corresponds to the mud-gas data seen in GOR log 401.

In FIG. 3*b* a well intervention operation has been carried out within the upper end portion 404 of the perforated region 402 to reduce or substantially prevent further production of injection gas from injection gas cap 422. The perforation region 402 now comprises a sealed portion 405 and an open portion 403. The intervention operation carried out in the upper end portion 404 of the perforated region 402 is such that reservoir fluid adjacent the lower open portion 403 of the can be produced by the production well 400. The intervention operation has been applied over a region spanning an additional length below the identified gas breakthrough location.

A method 500 of identifying a location of gas breakthrough within a completed production well is shown in FIG. 5.

At step 510 production composition data and/or tracer data from the production well is obtained.

At step 520 the production composition data and/or tracer data is analysed to determine whether gas breakthrough has occurred within the production well.

If it is determined that gas breakthrough has occurred the method proceeds to step 530 where mud-gas data collected during drilling of the production well is examined mud-gas to identify a gas breakthrough location within the well where the gas breakthrough has occurred.

If necessary, the method proceeds to step 540 where a well intervention operation is performed within the production well at the gas breakthrough location.

The invention claimed is:

1. A method of identifying a location of gas breakthrough within a completed production well, the method comprising:

obtaining production composition data and/or tracer data from the production well;

analysing the production composition data and/or tracer data to determine whether gas breakthrough has occurred within the production well; and in response to determining that gas breakthrough has occurred within the production well:

examining mud-gas data collected during drilling of the production well to identify a gas breakthrough location within the well where the gas breakthrough has occurred; and performing a well intervention operation within the production well at the gas breakthrough location in order to reduce production of fluid from adjacent the gas breakthrough location, wherein the well intervention operation comprises sealing or bypassing one or more perforations in a casing of the production well to prevent production by the production well of fluid from adjacent the gas breakthrough location.

2. The method according to claim 1, wherein the well intervention operation is applied over a region spanning at least 10 meters above and/or below the gas breakthrough location.

3. The method according to claim 1, wherein the well intervention operation prevents production by the production well of fluid from adjacent the gas breakthrough location, whilst maintaining fluid production from the other regions of the production well.

4. The method according to claim 1, wherein the gas breakthrough location is identified accurate to at least 10 meters.

5. The method according to claim 1, further comprising:

examining at least one of 4D seismic data, cuttings data and petrophysical data associated with the production well to verify the gas breakthrough location determined using the mud-gas data.

6. The method according to claim 1, wherein analysing the production composition data to determine whether gas breakthrough has occurred within the production well comprises determining that gas breakthrough has occurred when a production gas/oil ratio (GOR) exceeds a predetermined threshold GOR value.

7. The method according to claim 1, wherein examining the mud-gas data to identify the gas breakthrough location comprises identifying a location where a methane component in the mud-gas exceeds a predetermined threshold methane concentration value.

8. The method according to claim 1, wherein the mud-gas data comprises standard mud-gas data.

9. The method according to claim 1, wherein analysing the production composition data to determine whether gas breakthrough has occurred within the production well comprises determining that gas breakthrough has occurred when a fluid density is less than a predetermined threshold density value.

10. The method according to claim 1, wherein analysing the tracer data to determine whether gas breakthrough has occurred within the production well comprises determining that gas breakthrough has occurred when the concentration of a tracer fluid within the production fluid exceeds a predetermined threshold tracer concentration value.

* * * * *